United States Patent [19]

Davis

[11] 4,375,780

[45] Mar. 8, 1983

[54] FAIL-FIXED ELECTROHYDRAULIC SERVOSYSTEM

[75] Inventor: Donald Y. Davis, Cincinnati, Ohio

[73] Assignee: General Electric Company, Cincinnati, Ohio

[21] Appl. No.: 115,985

[22] Filed: Jan. 28, 1980

[51] Int. Cl.[3] ..... F15B 15/26

[52] U.S. Cl. ..... 91/42; 91/44; 91/387; 91/417 R; 137/85

[58] Field of Search ..... 91/41, 42, 387, 417 R, 91/44; 137/85; 92/25

[56] References Cited

U.S. PATENT DOCUMENTS

| | | | |
|---|---|---|---|
| 1,085,964 | 2/1914 | Briggs | |
| 2,832,200 | 4/1958 | Grout | 91/387 |
| 2,889,895 | 6/1959 | Snow | 91/42 |
| 3,034,483 | 5/1962 | Rasmussen | 91/44 |
| 3,122,972 | 3/1964 | Rasmussen | 91/41 |
| 3,270,621 | 9/1966 | De Ridder | 91/44 |
| 3,361,034 | 1/1968 | Rothrock | 91/42 |
| 3,492,921 | 2/1970 | Ray | 91/387 |
| 3,505,929 | 4/1970 | Coppola | 91/41 |
| 3,680,723 | 8/1972 | Seaberg | 91/387 |
| 3,753,350 | 8/1973 | Nott | 91/361 |
| 3,898,912 | 8/1975 | Wills | 91/44 |
| 3,922,955 | 12/1975 | Kast | 91/461 |
| 4,276,809 | 1/1978 | Kast | 91/417 R |

*Primary Examiner*—Abraham Hershkovitz
*Attorney, Agent, or Firm*—Francis L. Conte; Derek P. Lawrence

[57] ABSTRACT

A fail-fixed electrohydraulic servosystem in which a variation from a predetermined range of electrical input to the servosystem results in the output of the system being fixed in position. Fixing-in-position is accomplished by either hydraulically or mechanically locking a linkage to the output arm of the servosystem. Provision is also made for controlled drift and manual adjustment of the output after it is fixed in position.

11 Claims, 4 Drawing Figures

A-A

FAIL-FIXED ELECTROHYDRAULIC SERVOSYSTEM

BACKGROUND OF THE INVENTION

1. Field of the Invention

This invention relates to fail-fixed servosystems, and particularly to a new and improved servosystem in which a variation from a predetermined range of electrical input results in fixing-in-position of the system output, through either hydraulic or mechanical locking means, with means effective after fixing-in-position for providing controlled drift and manual adjustment of the output.

2. Description of the Prior Art

Electrohydraulic servovalves are widely used as interface devices between electrical control systems and mechanical or hydraulic metering or actuating devices. For example, in a gas turbine engine fuel control system, an electrical control signal generated by an electronic fuel control computer may be applied to the input of a servovalve. In response to the electrical input signal, the servovalve controls the movement of a servoposition which translates within a bore to generate a mechanical output signal which through a series of mechanical linkages varies the position of a mechanical fuel metering valve. Thus, the flow of fuel to the gas turbine engine, and therefore other engine parameters such as rotational speeds, can be accurately controlled as a function of the computer generated electrical signal.

Due to the widespread use of such servovalves in critical control systems, such as the above-described gas turbine engine fuel control system, it is desirable for the servosystem to be fail-fixed. By a fail-fixed servosystem it is meant that the mechanical output of the servovalve is locked, or fixed in position, in the event the electrical input signal varies from a predetermined range of values. The variation can be either a total loss of electrical input or an input which is above or below the predetermined range. The terms "fixing-in-position" or "fixed in position", therefore, mean that an element of a system, such as its output, is locked in position.

Most currently available fail-fixed electrohydraulic servosystems rely on electrical or hydromechanical feedback to provide an error signal to the electrohydraulic servo before the fail-fixed feature will operate, and thus introduce a potential unreliability factor in the feedback system with attendant uncontrolled and thus undesirable drifts of system output. Current systems do not provide for a controlled drift capability of the servosystem output after it is fixed in position. Controlled drift is an important feature in that it permits the output of the system to be automatically adjusted at a predetermined rate and in a predetermined direction from its fail-fixed position to a position which is considered desirable for safety and efficiency reasons. Additionally, most available arrangements do not permit manual adjustment of the system output after it is fixed in position. Where the servosystem is incorporated on an aircraft engine, for example, emergency temporary manual adjustment of a fixed in position component may be important in order to return the aircraft to a location where major repairs can be completed.

A primary object of the present invention is, therefore, to provide a new and improved fail-fixed electrohydraulic servosystem which will simply and reliably positively lock, or fix in position, the output of a servosystem in the event that the electrical input to the servosystem is lost or varies from a predetermined range of values.

Another object of the present invention is to provide a fail-fixed electrohydraulic servosystem with a controlled drift capability effective following fixing-in-position.

Still another object of the present invention is to provide a fail-fixed electrohydraulic servosystem with a means for enabling manual adjustment of the output after fixing-in-position.

SUMMARY OF THE INVENTION

The present invention, in accordance with one embodiment thereof, comprises a fail-fixed servosystem in which a variation from a predetermined range of electrical input to the servosystem results in the output of the servosystem being fixed in position. Additionally, the system is adaptable to provide, after fixing-in-position, both controlled drift of the output and manual adjustment of the output.

The servosystem, in one specific embodiment, comprises: an electrohydraulic servovalve which provides system output through movement of a servopiston positioned therein; a cylinder immersed in a container of hydraulic fluid and having a piston joined to it by a bellows; a solenoid-operated valve which, when closed due to a variation from a predetermined range of electrical input to the system, causes a hydraulic lock within the cylinder, locking, or fixing-in-position, the piston; and a mechanical linkage between the piston and the servopiston which correspondingly fixes in position the servopiston when the piston is fixed in position.

Another embodiment of the invention also results in the output fixing-in-position when electrical input to the system varies from a predetermined range. The servosystem includes: an electrohydraulic servovalve, the output of which results from movement of a servopiston positioned therein; a cylinder containing a piston, frictional locking members on which the piston, when actuated, exerts a force, a rod, connected through a mechanical linkage to the servopiston, on which the locking members exert a radial locking force, and means for unlocking the rod; and a solenoid-operated valve which, when system electrical input is lost, opens and allows hydraulic fluid under pressure to cause the piston to engage and exert an operating force on the locking members to lock the rod, and thus fix the servopiston in position. Manual adjustment of the output is also available after fixing-in-position.

DESCRIPTION OF THE PREFERRED EMBODIMENT

Figure 1:
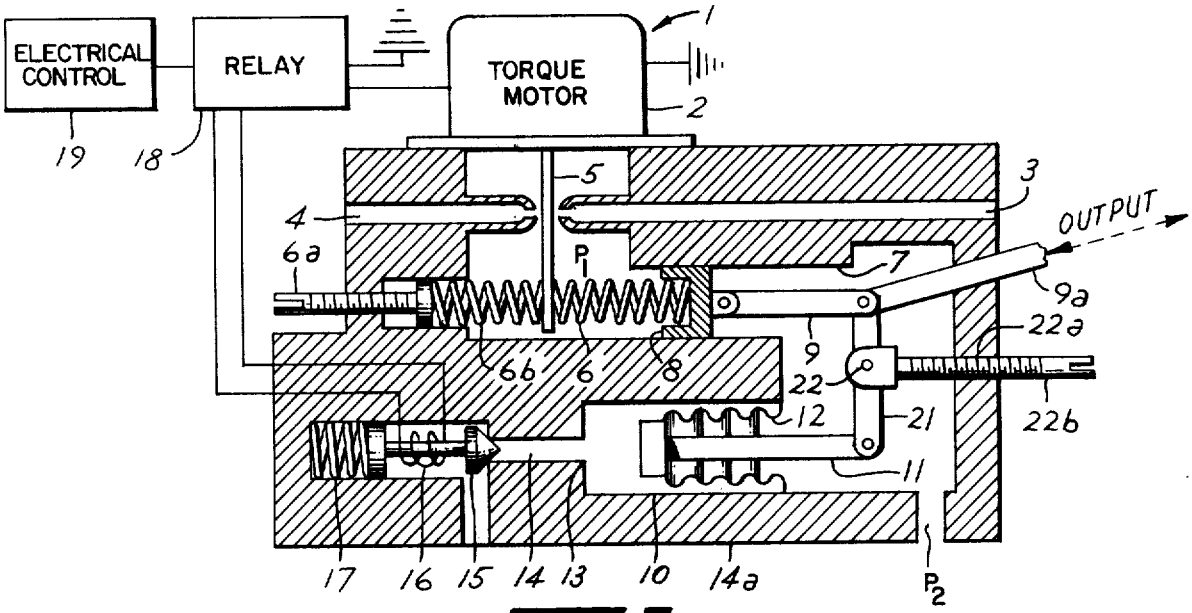
FIG. 1 is a schematic cross-sectional view of one embodiment of the fail-fixed servosystem of the present invention and which involves a hydraulic locking concept.

Turning now to a consideration of the drawing, and in particular to FIG. 1, there is shown a fail-fixed servosystem constructed in accordance with one embodiment of the present invention.

The output of the servosystem shown in FIG. 1 is provided by an electrohydraulic servovalve 1. The servovalve 1 is a typical proportional electrohydraulic servo and comprises a torque motor 2, hydraulic pressure supply conduits 3 and 4, a flapper 5, a force feedback spring 6 and an adjustment screw 6*a* cooperating with a load adjustment spring 6*b*. Translatably disposed within a bore 7 of the servovalve 1 is a servopiston 8. An electrical input to the servovalve 1 causes the torque motor 2 to correspondingly adjust the position of the flapper 5. The position of the flapper 5 in relation to the pressure supply conduits 3 and 4 determines the hydraulic pressure $P_1$ on the interior of the servovalve 1 and thus on the inner face of the servopiston 8. On the outer surface of the servopiston 8, a reference hydraulic pressure $P_2$ is suitably provided, for example, by a regulated pressure supply (not shown) suitably connected to the servovalve 1. A differential pressure $P_1-P_2$ across the servopiston 8 will cause it to translate within the bore 7, in either of two opposite directions depending on the position of the flapper 5, so as to equalize the forces generated by springs 6 and 6*b* and the pressure differential on piston 8. Thus, the movement of the servopiston 8 is proportional to the electrical input. Movement of the servopiston 8 results in a corresponding output motion transmitted through an output arm 9 appropriately pivotally connected to the outer side of the servopiston 8. Linkage 9*a* is pivotally connected at one end to output arm 9 and at its other end to whatever component is controlled by the servosystem output. The mechanical output of the servosystem is therefore proportional to the electrical input to the system. Although a servovalve including a flapper valve arrangement is shown, any other type of electrohydraulic servovalve may be used where the output is proportional to the input demand.

The fail-fixed servosystem shown in FIG. 1 operates on the basis of an hydraulic locking concept, and includes a cylinder 10 and a piston 11 translatably disposed within the cylinder. A bellows 12 is sealed at one end to the periphery of the head of the piston 11 and at the other end to the rim of the cylinder 10 such that the outer end of the cylinder 10 remains fluid-tight and the piston 11 is relatively free to reciprocate longitudinally therein. The bottom or inner end of the cylinder 10 is provided with an orifice 13 to which is connected a conduit 14. The conduit 14 provides communication for hydraulic fluid flow between the inside and outside of cylinder 10 which hydraulic fluid flow is controlled in a manner and for a purpose to be described hereinafter.

Preferably, the entire servosystem is located within a fluid-tight container, indicated by 14*a*, and is immersed in a supply of hydraulic fluid therein which is not shown. Alternatively, at least the cylinder 10, piston 11 and the conduit 14 for admitting fluid to the cylinder 10 are contained immersed in the fluid container. In each such arrangement, the piston 11 is adapted for translating or reciprocating freely within the cylinder 10 inasmuch as hydraulic fluid within the cylinder 10 may flow freely through the orifice 13 and the conduit 14 to or from the fluid supply external of the cylinder 10.

Such fluid flow, however, is controlled by a valve 15 in the conduit 14 and which, in its open position, allows fluid to move through the conduit 14, but in its closed position prevents fluid flow through conduit 14. Thus, when the valve 15 is closed, hydraulic fluid is trapped within the portion of the fluid circuit comprising the cylinder 10 and the portion of conduit 14 between cylinder 10 and the valve 15. As a result, when valve 15 is closed, piston 11 is hydraulically locked in position within the cylinder 10.

The valve 15 is preferably operated between its open and closed positions by means of a solenoid 16. In one arrangement, the solenoid 16 operates in combination with a spring 17 such that when electrical power is available to solenoid 16, valve 15 is held in its open position against the bias of spring 17, but when no, or insufficient, power is available to energize solenoid 16 to overcome the spring 17, the spring forces valve 15 into its closed position. In this arrangement, electrical power for energizing solenoid 16, and for operating the servovalve 1, is supplied through a relay 18 from a system electrical control 19. The control 19 can be any suitable device capable of transmitting an effective electrical input to the servosystem. The control 19 can, for example, be an electrical power source. It can, on the other hand, be an electronic control device which receives electrical signals from another source (not shown) to increase or decrease the output of the servosystem. Should the electronic control device receive what has been predetermined to be an overcurrent or undercurrent signal, including no current as would occur when all electrical power is lost due to a generator failure, the control device would send no electrical input to the relay 18. Thus, when the servosystem receives no electrical input, hydraulic locking of piston 11 occurs as a result of inadequate current at the solenoid 16 to prevent the spring 17 from causing the valve 15 to close.

Figure 1A:
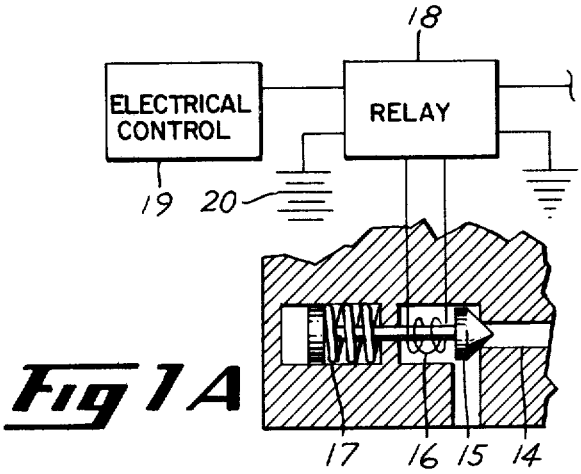
FIG. 1A is a schematic cross-sectional view of the embodiment shown in FIG. 1 showing an alternative arrangement for the solenoid-operated valve.

In another arrangement shown in FIG. 1A, the relay 18 operates such that solenoid 16 receives no electrical power when the electrical control 19 sends input to the system and the spring 17 is arranged to hold the valve 15 in its open position. In such an arrangement when the servosystem receives no input from the control 19, the relay 18 allows an auxiliary power source, such as a battery 20, to power the solenoid 16 which then closes the valve 15 causing the piston 11 to lock hydraulically in position.

The servosystem 8 is mechanically connected by a pivotal linkage to the piston 11 in such a manner that when the piston 11 is in its locked position, the servopiston 8 is also locked, or fixed in position. One example of such a mechanical connection is shown in FIG. 1 and includes a lever arm 21 pivotally connected at one end to the servovalve output arm 9, at the other end to the piston 11, and at its center to a fulcrum point 22. Thus, when the piston 11 is locked in position in the manner described above, the servopiston 8 and the output arm 9 are also locked or fixed in position, thereby fixing-in-position whatever component is connected to the servopiston through linkage 9*a*.

A manual adjusting device may also be included in the system. One example of such a device is shown in FIG. 1 comprising a fixed internally-threaded member 22*a* into which is screwed an adjusting member 22*b*. One end of the adjusting member 22*b* is connected to the fulcrum-point 22 such that when the adjusting member is rotated within the member 22*a*, the fulcrum-point 22 moves. This device allows output arm 9 and linkage 9*a* to be adjusted as desired even while piston 11 is locked in position. Such an adjustment capability is sometimes desirable with regard to the component influenced or controlled by movements of the output arm 9.

Figure 2:
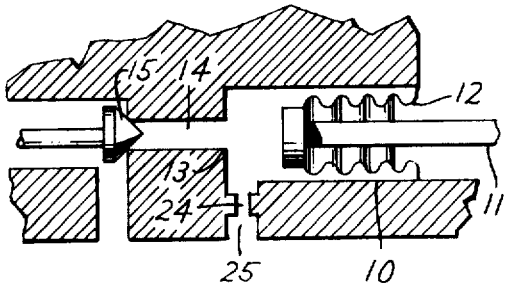
FIG. 2 is an enlarged schematic cross-sectional view of the cylinder included in the fail-fixed servosystem illustrated in FIG. 1 and showing a controlled drift feature incorporated therein.

Another feature which may be included in the above-described system is that which provides controlled drift. As shown in FIG. 2, an orifice 24 is provided in a wall section of the cylinder 10 and a conduit 25 is attached thereto. The conduit 25 provides communication between the inside and outside of the cylinder 10. In this arrangement, when the valve 15 closes, the hydraulic fluid trapped within the cylinder 10 and the portion of conduit 14 between valve 15 and the cylinder is permitted to escape slowly through the orifice 24 and the conduit 25. Piston 11 will, as a consequence, drift from its initial locked position at a rate controlled by the size of the orifice 24. The rate of drift desired can be achieved by predetermined selection of a proper sized orifice. However, in order to induce drift, the servovalve 1 must be biased such that when no input is received from the electrical control 19, the servopiston 8 will be urged to translate so as to also urge the piston 11 to translate within the cylinder 10 and thus establish forces on the fluid therein which results in such fluid being expelled or induced through the orifice 24.

In operation, the components of this configuration of the fail-fixed servosystem cooperate as follows: when electrical input to the servosystem varies from a predetermined range, the electrical control 19 sends zero electrical input to the relay 18, the solenoid-operated valve 15 closes trapping hydraulic fluid in the cylinder 10 and in the section of conduit 14 between the valve and cylinder. Piston 11 is thusly hydraulically locked in position. Output arm 9 is then fixed in position, as it is mechanically interconnected by the pivoted lever arm 21 to piston 11. Output arm 9 may be manually adjusted by means of the manual adjustment device 22*a* which adjustably moves the pivot-point 22 of lever arm 21. Additionally, if orifice 24 and conduit 25 are added to the system, output arm 9 will drift from its fixed position at a rate controlled by the size of the orifice 24 and in a direction controlled by the bias provided by the servovalve 1. When electrical input to the servosystem is again within the predetermined range, the valve 15 opens and permits the piston 11 to freely translate within the cylinder 10. The output arm 9 is thus no longer fixed in position.

Figure 3:
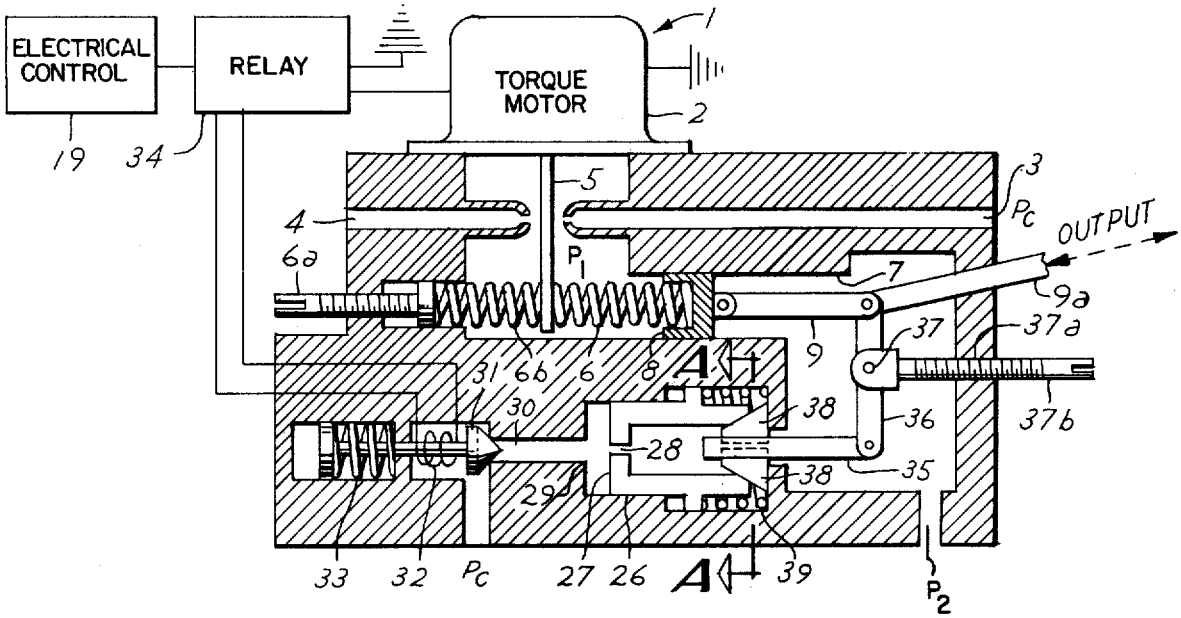
FIG. 3 is a schematic cross-sectional view of a second embodiment of the fail-fixed servosystem of the present invention and which involves a mechanical locking concept.

A second embodiment of the fail-fixed servosystem, shown in FIG. 3, utilizes a mechanical locking concept, but can otherwise be essentially the same as the first-described embodiment. Accordingly, the same numerals are used to indicate identical elements included in both embodiments. The second embodiment includes a cylinder 26 and a piston 27 translatably disposed therein. The head of the piston 27 includes an orifice 28. The bottom or end of the cylinder nearer the orifice 28 also includes an orifice 29 leading to a conduit 30. The conduit 30 is connected to a source of hydraulic pressure. One source of pressure which can be used is that also used by servovalve 1 and depicted as $P_c$. However, any suitable source can be utilized as long as the pressure will be maintained even when a variation from a predetermined range occurs in the system electrical input.

Figure 3A:
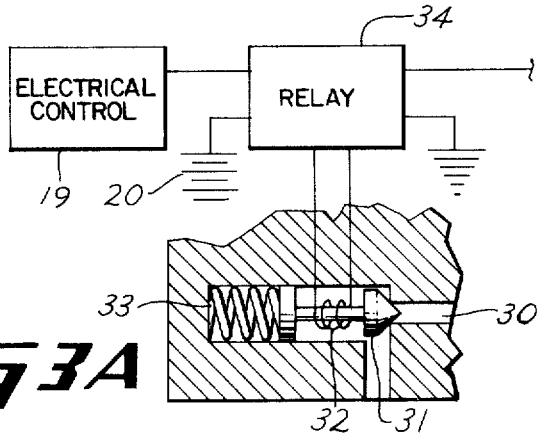
FIG. 3A is a schematic cross-sectional view of the embodiment shown in FIG. 3 showing an alternative arrangement for the solenoid-operated valve.

Provided in the conduit 30 is a valve 31 operated by a solenoid 32 in cooperation with a spring 33. As long as the electrical control 19 is sending electrical input to the servosystem, valve 31 remains in its closed position, thus preventing pressurized hydraulic fluid from entering the cylinder 26. When the control 19 sends zero electrical input to the system, however, valve 31 opens, porting hydraulic fluid under pressure into cylinder 26. FIG. 3 shows one arrangement which will insure proper movement of valve 31 as described above. In this arrangement, when electrical input is received from the control 19, the relay 34 sends power to energize the solenoid 32, allowing it to hold the valve 31 in the closed position. When no electrical input is received from the control 19, the solenoid 32 loses electrical power and the spring 33 forces the valve 31 to its open position. In another arrangement shown in FIG. 3A, the solenoid 32 and the spring 33 are repositioned such that when electrical input is received from the control 19, the relay 34 allows the solenoid 32 to remain unenergized and the spring 33 forces the valve 31 into its closed position. However, when electrical input from the control 19 is zero, the relay 34 allows an auxiliary power source, such as a battery 20, to energize the solenoid 32 and open the valve 31.

A rod 35 is mechanically interconnected or coupled to the servopiston 8 and the output arm 9 such that when the rod 35 is locked in position, the output arm 9 is also locked, or fixed in position. One arrangement, shown in FIG. 3, which accomplishes this involves the use of a lever arm 36 which is pivotally connected at one end to the output arm 9, at the other end to the rod 35, and at its center to a fulcrum-point 37. Any other suitable arrangement can be effectively utilized as long as the output arm 9 is fixed in position when the rod 35 is locked. Additionally, a manual adjustment device may be incorporated into the system. One example of such a device is shown in FIG. 3 comprising a fixed, internally-threaded member 37*a* into which is screwed an adjusting member 37*b*. One end of the adjusting member 37*b* is connected to the fulcrum-point 37 such that when the adjusting member is rotated within the member 37*a*, the fulcrum-point 37 moves. This device allows manual adjustment of the output arm 9 as desired after it is fixed in position.

Figure 4:
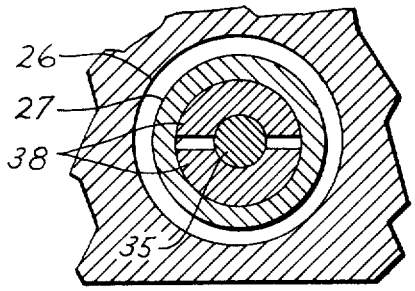
FIG. 4 is a schematic cross-sectional view illustrating the locking members of the second embodiment and taken along lines A—A of FIG. 3.

The portion of the cylinder 26 opposite the conduit 29 contains at least one, and preferably a plurality of frictional locking members 38 cooperating with the rod 35 to lock and release it in accordance with fluid pressure exerted in the cylinder 26. As shown in FIGS. 3 and 4, one effective arrangement comprises two wedge-shaped frictional locking members 38, the outer surfaces of which extend at an angle corresponding to the angle of an edge of piston 27 cooperating with the locking members. The shape of the inner surfaces of the locking members 38 correspond to the shape of the rod 35 which is slidably movable therebetween. Biasing means, such as a spring 39, is provided to urge the piston 27 toward conduit 29 whenever the valve 31 is closed. This allows the locking members 38, which have some freedom of movement in a direction radially from the rod 35 and perpendicular to the direction of movement of the piston 27, to separate sufficiently for the rod 35 to move freely therebetween. However, when the valve 31 opens, porting hydraulic fluid under pressure into the cylinder 26, the fluid force acting on the head of the piston 27 is sufficient to overcome the force of the spring 39 and move the piston 27 against the locking members 38. The locking members 38 in turn are forced inwardly by a camming action into contact with the rod 35 and exert sufficient radial forces on the rod 35 to lock it in the position indicated in FIG. 3.

When the valve 31 closes, the pressure on the head side of piston 27 is reduced sufficiently by the escape of hydraulic fluid through the orifice 28 for the spring 39 to move the piston 27 back toward the orifice 29, allowing the locking members to separate and unlock the rod 35.

Although FIG. 3 shows the locking members 38 as wedge-shaped, any other shape or type of a locking member can be used where such member translates the force of hydraulic fluid on the piston 27 into a locking force effective to restrain rod 35 longitudinally.

In operation, this embodiment of the fail-fixed servosystem functions as follows: when electrical input to the servosystem varies from a predetermined range, the electrical control 19 sends no electrical input to the relay 34, the solenoid-operated valve 31 opens allowing hydraulic fluid under pressure to be ported into the cylinder 26, forcing the piston 27 against the locking members 38 which exert radially inwardly directed forces on rod 35 for locking it in position. The output arm 9, which is interconnected to rod 35, is also thereby locked, or fixed in position. Manual adjustment of the position of output arm 9 after it is fixed in position is available if the manual adjusting device 37*a* is incorporated.

It is to be understood that this invention is not limited to the particular embodiment disclosed, and it is intended to cover all modifications coming within the true spirit and scope of this invention as claimed.

What is claimed is:

1. A fail-fixed electrohydraulic servosystem for positioning a component to be controlled in response to an electrical input comprising:

(1) an electrohydraulic servovalve including a translatably positionable servopiston having an end connectable to the component to be controlled, the position of said servopiston being proportional to the electrical input;

(2) linkage means including a lever arm having first and second end portions and an intermediate portion disposed therebetween, said first end portion being pivotably connected to said servopiston and said intermediate portion being pivotably connected to a fulcrum member connected to a fixed member;

(3) a rod having first and second end portions, said first end portion being pivotably connected to said second end portion of said lever arm; and (4) locking means cooperating with said second end portion of said rod for securing said rod in a fixed position when the electrical input varies from a predetermined range, thereby fixing said servopiston in a locked position, including:

(a) a cylinder having a conduit providing communication of hydraulic fluid from a pressurized source thereof, containing a piston translatably actuatable in response to fluid pressure in said cylinder and receiving slidably said second end portion of said rod;

(b) means including a valve in said conduit operative when the electrical input to said servosystem varies from said predetermined range to open said valve to effect a translatory actuation of said piston; and (c) a frictional locking member cooperating with said second end portion of said rod and said piston and effective for frictionally locking said rod relative to said cylinder upon actuation of said piston.

2. The fail-fixed servosystem according to claim 1, wherein said linkage means includes means for manual adjustment of the position of said servopiston in said servovalve.

3. The fail-fixed servosystem according to claim 1, wherein said fulcrum member of said linkage means is adjustably connected to said fixed member, said fulcrum member being translatable for rotating said lever arm and thereby adjusting the position of said servopiston in said servovalve from said locked position when said rod is in said fixed position.

4. The fail-fixed servosystem according to claim 1, wherein said frictional locking member is disposed in said cylinder and includes a cam surface, and wherein said piston includes a cam surface cooperating with said cam surface of said locking member and effective when said piston is actuated for urging said frictional locking member into engagement with said second portion of said rod.

5. The fail-fixed servosystem according to claim 1, wherein said frictional locking member comprises a plurality of wedge-shaped frictional locking members surrounding said second portion of said rod and having slight freedom of movement in a direction radially relative thereto, and wherein said piston is tubular and cooperates with said locking members when actuated to urge said locking members into frictional locking engagement with said rod.

6. The fail-fixed servosystem according to claim 1, wherein said servosystem further comprises means effective for unlocking said rod relative to said cylinder when said electrical input to said servosystem is within said predetermined range.

7. The fail-fixed servosystem according to claim 1, wherein said valve in said conduit comprises a solenoid-operated valve.

8. The fail-fixed servosystem according to claim 7, wherein said solenoid-operated valve is energized by an auxiliary power source when said electrical input to said servosystem varies from said predetermined range.

9. A fail-fixed electrohydraulic servosystem according to claim 1 wherein said servopiston further includes an output arm extending therefrom and said first end portion of said lever arm of said linkage means is pivotably connected to said output arm.

10. A fail-fixed electrohydraulic servosystem for positioning a component to be controlled in response to an electrical input comprising:

(1) an electrohydraulic servovalve including a translatably positionable servopiston having an end connectable to the component to be controlled, the position of said servopiston being proportional to the electrical input;

(2) linkage means including a lever arm having first and second end portions and an intermediate portion disposed therebetween, said first end portion being pivotably connected to said servopiston and said intermediate portion being pivotably connected to a fulcrum member connected to a fixed member;

(3) a rod having first and second end portions, said first end portion being pivotably connected to said second end portion of said lever arm; and (4) locking means cooperating with said second end portion of said rod for securing said rod in a fixed position when the electrical input varies from a predetermined range, thereby fixing said servopiston in a locked position, including:

(a) a cylinder having a conduit providing communication of hydraulic fluid from a pressurized source thereof, containing a piston having a portion defining a cam surface and being longitudinally actuatable in said cylinder in response to fluid pressure in said cylinder and receiving slidably said second end portion of said rod;

(b) means including a solenoid-operated valve in said conduit and operative when the electrical input to said servosystem varies from said predetermined range to open said valve to effect actuation of said piston, and to close said valve when said electrical input to said servosystem is within said predetermined range;

(c) a plurality of wedge-shaped locking members surrounding said rod and having cam surfaces cooperating with said cam surface on said piston and movable by said piston into frictional locking engagement with said rod when said piston is actuated; and (d) means effective for unlocking said rod relative to said cylinder when said electrical input to said servosystem is within said predetermined range; and wherein said fulcrum member is manually translatable with respect to said fixed member for thereby adjusting the position of said servopiston.

11. The fail-fixed servosystem according to claim 10, wherein said means for unlocking said rod comprises an orifice in said piston for enabling equalization of fluid pressure across said piston, and a spring in said cylinder for biasing said piston out of cooperation with said locking members.

* * * * *